US007528787B2

(12) United States Patent
Louzir et al.

(10) Patent No.: US 7,528,787 B2
(45) Date of Patent: May 5, 2009

(54) SOURCE ANTENNAS WITH RADIATING APERTURE

(75) Inventors: Ali Louzir, Rennes (FR); Jean-Francois Pintos, Bourgbarre (FR); Philippe Chambelin, Chateaugiron (FR); Florent Averty, Rennes (FR); Dominique Lo Hine Tong, Rennes (FR); Corinne Nicolas, La Chapelle des Fougeretz (FR); Christian Person, Locmaria Plouzane (FR); Jean-Philippe Coupez, Le Relecq Kerhuon (FR); Gabrielle Landrac, Plouzane (FR)

(73) Assignee: Thomson Licensing, Boulogne Billancourt (FR)

( * ) Notice: Subject to any disclaimer, the term of this patent is extended or adjusted under 35 U.S.C. 154(b) by 130 days.

(21) Appl. No.: 10/975,800

(22) Filed: Oct. 28, 2004

(65) Prior Publication Data

US 2005/0093759 A1 May 5, 2005

(30) Foreign Application Priority Data

Oct. 31, 2003 (FR) ..... 03 50767

(51) Int. Cl.
*H01Q 13/00* (2006.01)

(52) U.S. Cl. ..... 343/786

(58) Field of Classification Search ..... 343/786, 343/753–754, 772, 784–785; 73/90
See application file for complete search history.

(56) References Cited

U.S. PATENT DOCUMENTS

| | | | | | |
|---|---|---|---|---|---|
| 4,783,665 | A * | 11/1988 | Lier et al. | ..... | 343/786 |
| 4,788,553 | A * | 11/1988 | Phillips | ..... | 343/786 |
| 4,825,221 | A * | 4/1989 | Suzuki et al. | ..... | 343/785 |
| 5,166,698 | A * | 11/1992 | Ashbaugh et al. | ..... | 343/783 |
| 5,706,017 | A * | 1/1998 | Buttgenbach | ..... | 343/753 |
| 5,872,494 | A * | 2/1999 | Palan et al. | ..... | 333/252 |
| 5,883,604 | A * | 3/1999 | Nicely | ..... | 343/786 |
| 6,661,389 | B2 * | 12/2003 | Griessbaum et al. | ..... | 343/786 |
| 6,859,187 | B2 * | 2/2005 | Ohlsson | ..... | 343/772 |
| 2002/0101387 | A1 * | 8/2002 | Brandau | ..... | 343/786 |
| 2003/0151560 | A1 * | 8/2003 | Kienzle et al. | ..... | 343/786 |
| 2003/0167839 | A1 | 9/2003 | Burger et al. | ..... | 73/290 |

OTHER PUBLICATIONS

Philips B., et al.: "*Design and Performance of Profiled Dielectric Loaded Horns*", IEEE Proceedings: Microwaves, Antennas and Propagation, IEE, Stevenage, Herts, GB, vol. 141, No. 5.

Patent Abstracts of Japan, vol. 0171, No. 25 (E-1332), Mar. 16, 1993 and JP 4 301902 A (Mitsubishi Electric Corp.), Oct. 26, 1992.

*EPO Search Report.*

* cited by examiner

*Primary Examiner*—Huedung Mancuso
(74) *Attorney, Agent, or Firm*—Robert D. Shedd; Joseph J. Opalach; Brian J. Cromarty

(57) ABSTRACT

The invention relates to a source antenna constituted by a radiating aperture comprising at least one insert made of a dielectric material mounted floating inside the aperture.

3 Claims, 6 Drawing Sheets

SOURCE ANTENNAS WITH RADIATING APERTURE

This application claims the benefit, under 35 U.S.C. § 119 of French Patent Application 03/50767, filed Oct. 31, 2003.

FIELD OF THE INVENTION

The present invention relates to source antennas constituted by a radiating aperture, more particularly by a horn. It also relates to an antenna structure comprising a source antenna in accordance with the invention, associated with a focusing system of the homogeneous lens type.

BACKGROUND OF THE INVENTION

In the case of low-orbit satellite communication systems, the use of a focusing system of the parabola type is not adequate. Specifically, in order to ensure the continuous tracking of nongeostationary satellites over their trajectory and to avoid the interruption of communication when said satellites are no longer in direct line of sight with the ground antenna, the latter must exhibit, at least during the period of switching from one satellite to another, two separate beams. Moreover, the angular coverage of the beams must be ensured over a very wide area.

To respond to these problems, it is possible to use a focusing system of the Luneberg lens type which, by virtue of its spherical symmetry, makes it possible to envisage a multitude of beams and the tracking of satellites over a wide angular sector by simple displacement of the transmission/reception sources in the focal surface of the lens. However, the practical embodiment of a Luneberg lens is complex and expensive. Consequently, in place of a Luneberg lens, it is possible to envisage the use of a homogeneous spherical lens.

A homogeneous lens exhibits a lower manufacturing cost. However, it does not allow perfect focusing of an incident plane wave. Specifically, aberration phenomena are noted at the level of the focal surface. In the case of a homogeneous lens, one no longer speaks of a focal point as in a focusing system constituted by a parabola or a Luneberg lens but of a focal spot, the focusing area being more extended.

Consequently, the exit focusing imperfections of a homogeneous lens render the design constraints of the associated primary source antenna more complex. The main function of the source antenna associated with the homogeneous lenses is therefore to take into account and to compensate as well as possible for the phase and amplitude distortions introduced by this imperfect focusing system.

Thus, the application of Robieux's theorem makes it possible to show that the efficiency of an antenna system comprising a primary source antenna and its associated focusing system is optimal when the electric field E and magnetic field H of the source antenna and of the focusing system are mutually conjugate. The distribution of the fields in the aperture of the source antenna must therefore be identical to that of the focusing system in amplitude and its phase response must be in phase opposition.

The present invention therefore relates to a source antenna which makes it possible to obtain a distribution of the fields in its radiating aperture and which superimposes as well as possible with that generated by the focusing system. When the focusing system is a system of parabola type, the solution conventionally used for the source antenna is a horn. However, in the case of source antennas such as horns, the technique generally employed to ensure the symmetrization of the E and H planes consists in the addition of transverse or longitudinal furrows or corrugations inside or outside the horn so as to modify the modal distribution of the electromagnetic fields at the level of the aperture of the horn. The corrugations in fact introduce higher hybrid modes into the guided structure at the level of the corrugations, which make it possible to harmonize the phase- and amplitude-response in the aperture of the horn.

However, when the focusing system is a homogeneous lens, the focusing being less effective than at the exit of a focusing system of conventional parabola type, this translates into a much more extended focusing area. Therefore, corrugated horns do not constitute the best solution in the case of a focusing system of the homogeneous lens type.

Consequently, the present invention proposes another solution for the source antenna constituted by a radiating aperture.

BRIEF SUMMARY OF THE INVENTION

In accordance with the invention, the antenna consists of a source antenna of radiating aperture type inside which is disposed a dielectric insert. The use of the dielectric insert makes it possible:

1) to establish the symmetry of the phase response, in particular on account of the fact that, according to a characteristic of the invention, the insert exhibits, along a section transverse to the aperture, an elliptical shape, 2) to adapt the phase- and amplitude-response of the source antenna to that of the homogeneous lens by altering the positioning and the longitudinal profile of the dielectric insert. In particular the insert exhibits along a section made along the axis Oz of radiation of the aperture a concave or convex shape. This specific shape will modify the optical path, hence the phase response inside the radiating aperture and the amplitude distribution.

According to another characteristic of the present invention, the radiating aperture is constituted by a horn.

According to a first embodiment, the horn is formed by a block of foam made of synthetic material whose external surface is metallized, the said block exhibiting an internal recess for receiving the insert.

According to another embodiment, the horn is constituted by a block of foam made of synthetic material recessed internally and exhibiting metallized internal and external surfaces.

The present invention also relates to an antenna structure comprising a source antenna such as described above, associated with a focusing system of the homogeneous lens type.

BRIEF SUMMARY OF THE DRAWINGS

Other characteristics and advantages of the present invention will become apparent on reading the description given hereinafter of various embodiments, this description being given with reference to the annexed figures in which.

To simplify the description in the figures, the same elements bear the same references.

DESCRIPTION OF PREFERRED EMBODIMENTS

Figure 1:
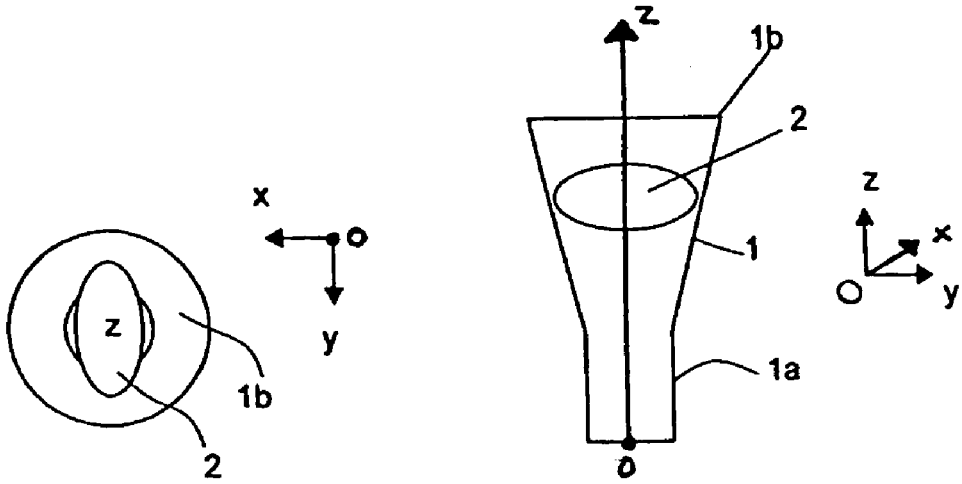
FIG. 1 depicts respectively a view in transverse and longitudinal section of a source of horn type furnished with a dielectric insert.

An embodiment of the source antenna in accordance with the present invention will firstly be described with reference to FIGS. 1 to 8. In this case, as represented in FIG. 1, the radiating aperture forming the source antenna is constituted by a horn 1 made of a radiating material exhibiting, at one end, a cylindrical shape 1*a* which flares out progressively up to its aperture 1*b*.

In accordance with the invention, inside the horn 1 is mounted an insert 2 made of a dielectric material.

The materials that may be used are the materials known by the commercial name:

Eccostock Lok: permittivity 1.7 loss tangent 0.004

Eccostock SH-14: permittivity 1.25 loss tangent 0.005

In a general manner, any dielectric material of permittivity >1 and with a low enough loss tangent to minimize the dielectric losses may be used, this material possibly being machinable or mouldable.

Figure 3:
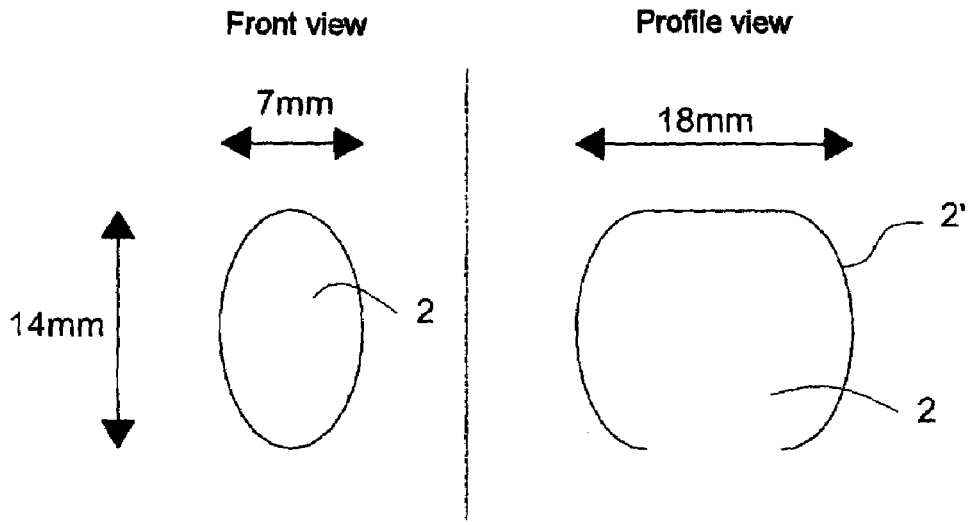
FIG. 3 are diagrammatic front and profile views of the geometry of the insert.

As represented clearly in the cross section of FIG. 1, the dielectric insert 2 exhibits an elliptical front view. In fact, the shape of the insert is represented in greater detail in FIG. 3. The left-hand view of FIG. 3 represents the elliptical face of the insert 2 while the right-hand view is a profile view and shows that the insert 2 has a concave shape, according to its longitudinal profile. The insert dimensions given in FIG. 3 will be used subsequently for simulations.

Figure 2:
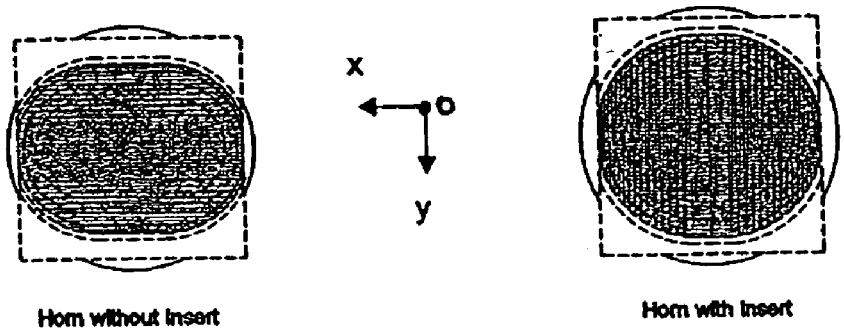
FIG. 2 depicts the phase charts in the case of a horn without insert and of a horn with insert.

The role of the dielectric insert is represented in FIG. 2 which gives the phase charts obtained in the aperture of a conventional horn linearly polarized along the axis Ox, respectively in the case where the horn has no insert (left-hand figure), and in the case where the horn has an elliptical dielectric insert (right-hand figure). As is clearly apparent in the figures, the addition of the elliptical insert makes it possible to symmetrize the phase response in the aperture of the horn. This translates, at the level of the radiation pattern, into a symmetrization in the E and H planes.

Moreover, the geometry of the dielectric insert is important for obtaining this symmetrization. The elliptical nature of the insert is necessary to ensure the symmetrization of the phase response, the elliptical profile being all the more accentuated the bigger the phase dissymmetry of the horn without insert.

Moreover, the longitudinal profile of the slightly concave insert, as illustrated in FIG. 3, and the positioning of the insert inside the horn are two parameters that make it possible to adapt, in an optimal manner, the phase- and amplitude-response with respect to the desired response of a given lens. The positioning of the insert along the axis Oz greatly influences the amplitude correction, the concave profile allowing it to reduce the phase shift between central and marginal rays.

Figure 4:
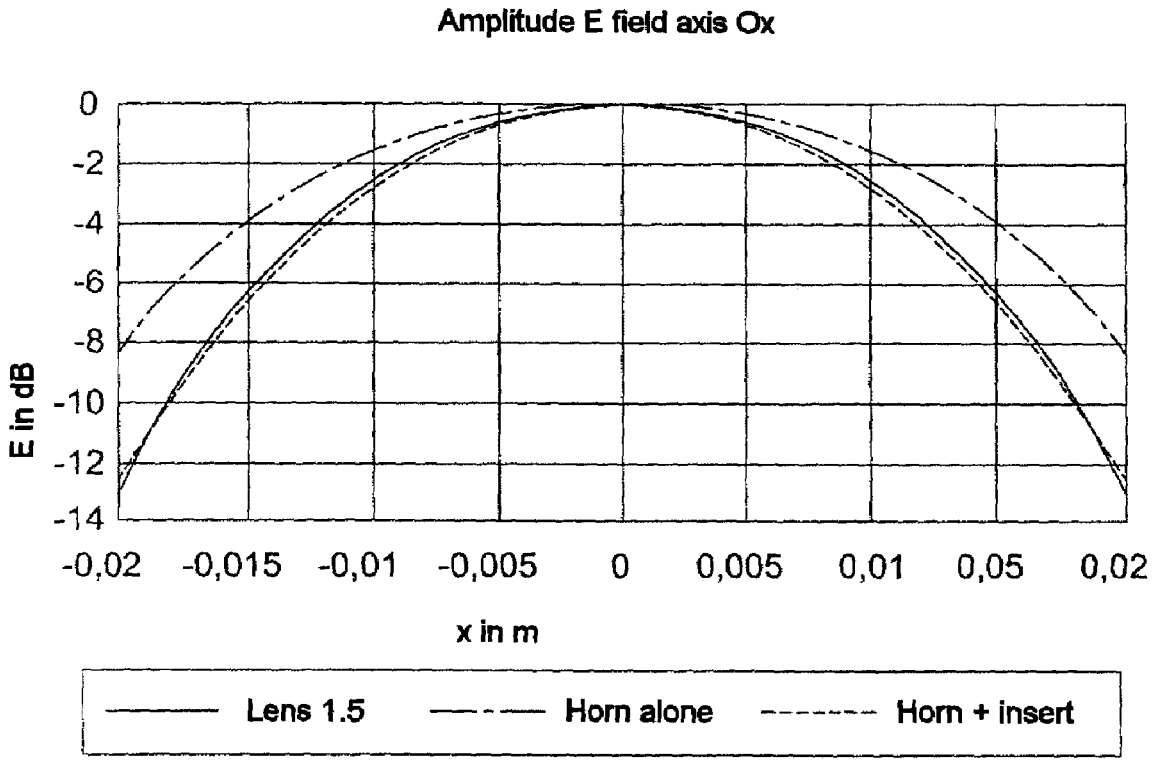
FIG. 4 is a curve giving the amplitude of the E field along the axis $O\vec{x}$ for the lens, the horn alone and the horn with insert.
Figure 5A:
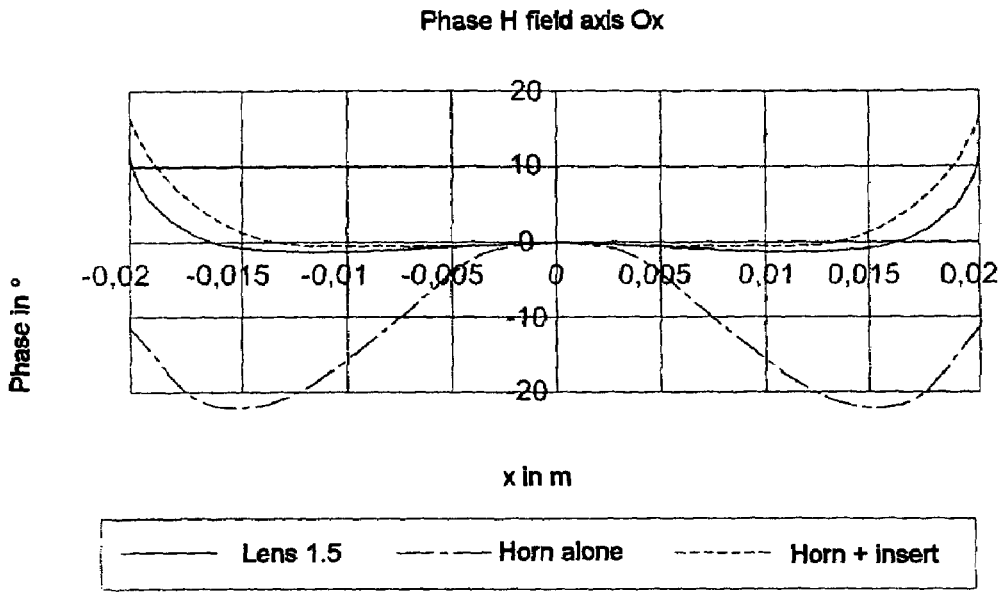
FIGS. 5A and 5B are curves identical to that of FIG. 4 in the case of the phase of the E field and of the H field along the axis $O\vec{x}$.
Figure 5B:
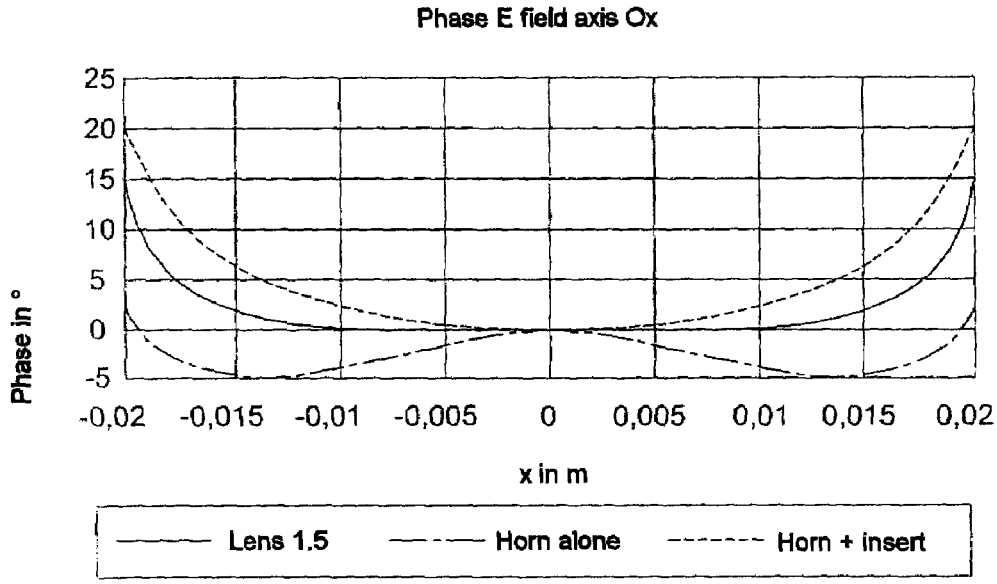

The results obtained by the insertion of an elliptical insert into a horn such as represented in FIG. 1 have been verified using the programme known by the trade name "Feko" on the basis of a horn excited by a linear polarization along the axis Ox at 12 GHz. The horn has been dimensioned in such a way as to ensure the illumination of a homogeneous dielectric lens of permittivity 1.5 and 30 cm in diameter. This horn exhibits a diameter of 4 cm at the level of the top-centered radiating aperture and the insert exhibits the dimensions given in FIG. 3, namely a major axis of the ellipse of 14 mm, a minor axis of 7 mm and a depth between the two concave parts of 18 mm with a permittivity of 1.4. The results of the simulations are given in the various curves 4, 5A, 5B, 6, 7 and 8. The curves of FIGS. 4, 5A and 5B are curves giving either the amplitude of the E field along the Ox axis, or the phase of the E field and the phase of the H field along the same axis. When the various curves are compared respectively for the lens, the horn alone and the horn plus insert, it is seen that the addition of the dielectric insert makes it possible to adapt the exit field distributions of the horn to those of the lens at the level of the focal spot, and to do so both in terms of phase and amplitude.

Figure 6:
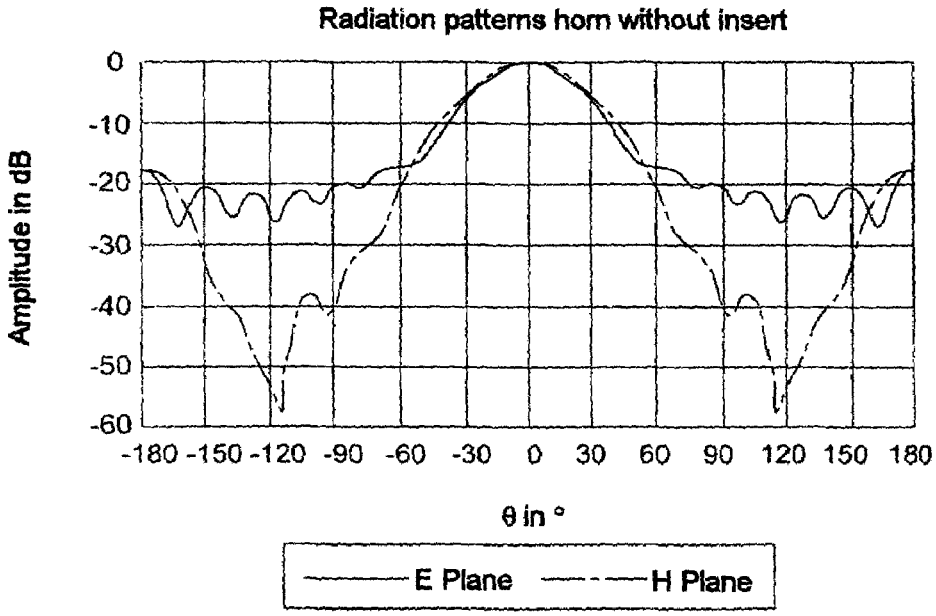
FIG. 6 represents the radiation pattern in the E and H planes of a source antenna of horn without insert type.
Figure 7:
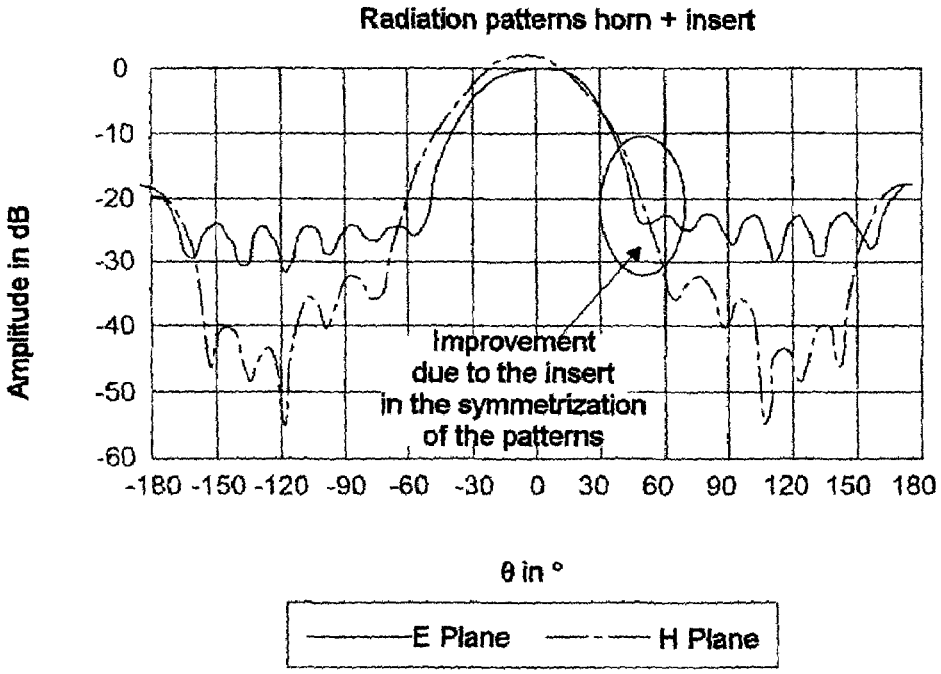
FIG. 7 represents the radiation pattern in the E and H planes of a source antenna of horn with insert type.

Moreover, the symmetrization of the phase response translates into a significant improvement in the radiation pattern, as shown by FIGS. 6 and 7 which represent, in the case of FIG. 6 the radiation pattern of the horn without insert and, in the case of FIG. 7, the radiation pattern of the horn with insert. In these figures, it is seen that the elliptical insert makes it possible to symmetrize the responses in the E and H planes while making it possible to reduce the level of the side lobes.

Figure 8:
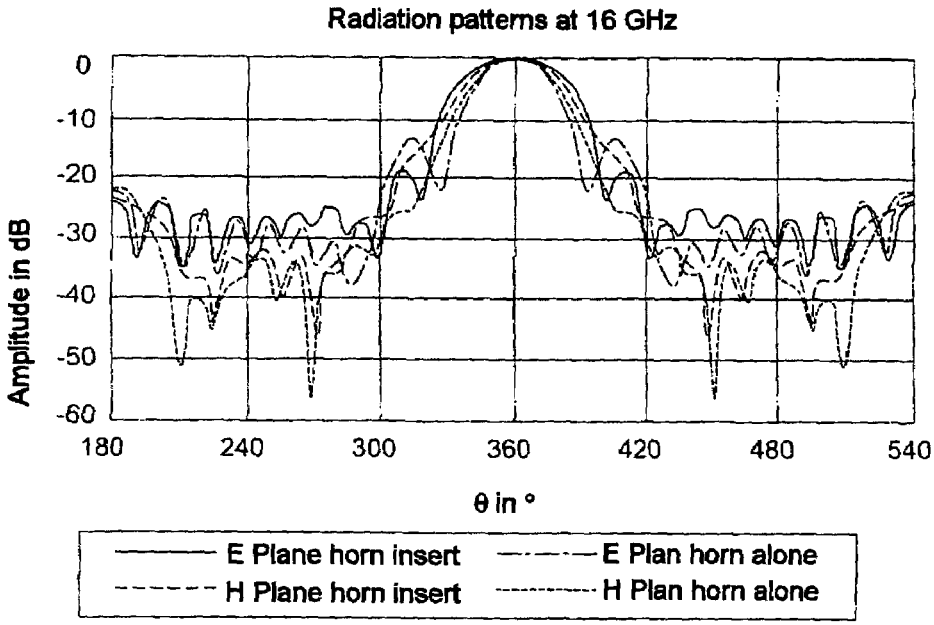
FIG. 8 represents various radiation patterns at 16 GHz.

Thus, as represented in FIG. 8, the insert affords significant improvements together with a big reduction in the side lobes, this making it possible to achieve wideband operation.

Various embodiments of a source antenna of horn type as well as various embodiments of the present invention will now be described with reference to FIGS. 9 to 13.

Figure 9:
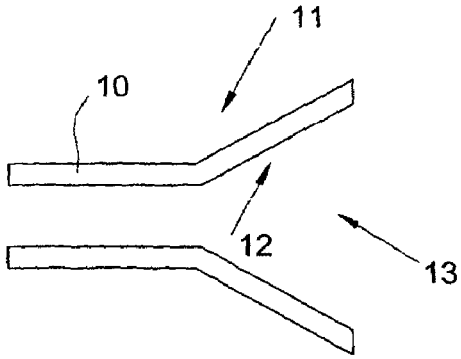
FIG. 9 is a diagrammatic view of a first embodiment of a horn.

As represented in FIG. 9, the horn may be constituted by a block of foam 10 which has been recessed internally and which exhibits an external metallization 11 and an internal metallization 12, the inside of the horn being filled with air. In this case, the floating insert may be fixed in a groove provided inside the horn but not represented in FIG. 9.

Figure 10:
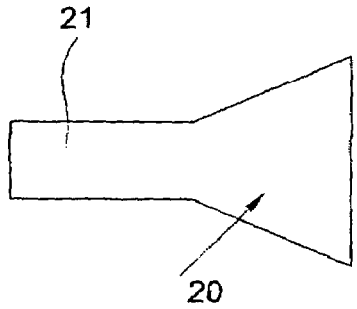
FIG. 10 is a diagrammatic view of a second embodiment of a horn.

Represented in FIG. 10 is another embodiment of a horn using the foam technology. In this case, the horn is constituted by a solid block of foam made of a synthetic material shaped to have a cylindrical part which extends as a flared part. In this case, the external surface of the foam block 20 is metallized so as to make the source antenna.

The foam horn may be made from materials known by the commercial name:

Rohacell 71: permittivity 1.09 loss tangent 0.0038 or,

Eccostock PP: permittivity range from 1.03 to 1.1 loss tangent 0.0002.

Various alternative embodiments of the horn in the case where the horn is constituted by a metallized foam block, as described with reference to FIG. 10, will now be described with reference to FIGS. 11, 12 and 13.

Figure 11:
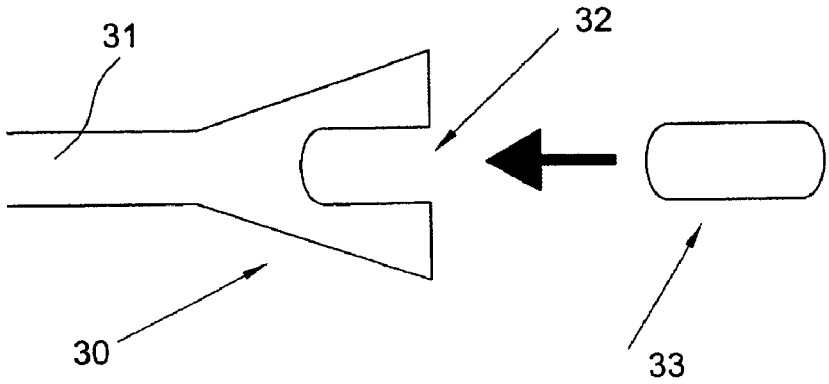
FIG. 11 is a sectional view of an embodiment of a horn furnished with an insert, in accordance with the present invention.

In the case of FIG. 11, the foam block 30 receives a metallization 31 on its external surface. Moreover, the aperture side of the horn 30 is furnished with a nook 32 of concave shape that allows the insertion of an insert 33 made of a dielectric material, exhibiting a shape of the type of that described with reference to FIG. 3. This insert exhibits a slightly concave profile, making it possible to reduce the phase shift of the marginal rays with respect to the central rays.

Figure 12:
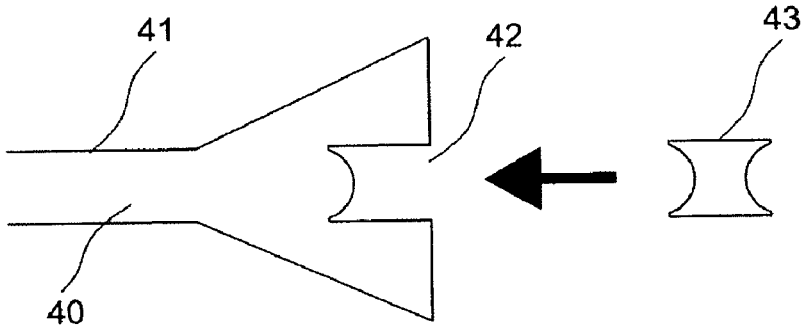
FIG. 12 is a sectional view identical to FIG. 11 for a second embodiment.

Represented in FIG. 12 is a horn 40 similar to the horn of FIG. 11. This horn is furnished on its external surface with a metallization 41 and it exhibits at the level of its aperture a nook 42 allowing the insertion of the dielectric insert 43. However, in this embodiment, the insert 43 exhibits a profile of convex type which makes it possible, on the contrary, to increase the phase shift of the marginal rays with respect to the central rays.

Figure 13:
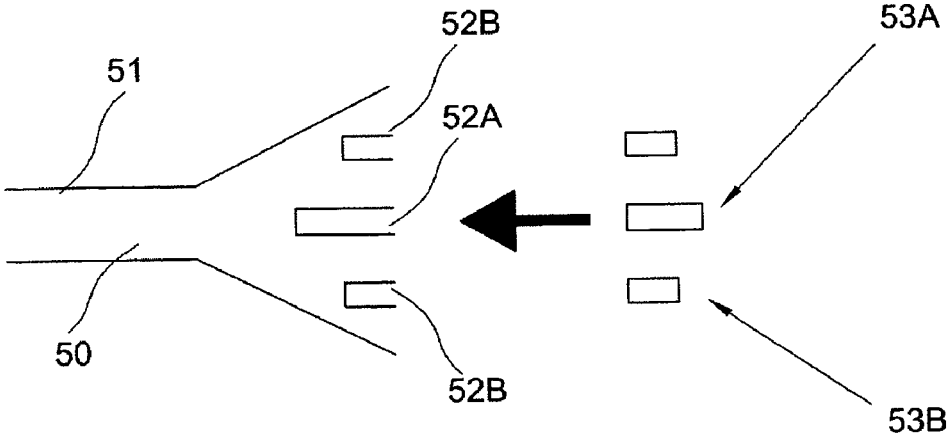
FIG. 13 is a sectional view identical to those of FIGS. 11 and 12 for a third embodiment.

Represented in FIG. 13 is yet another embodiment of a horn constituted by a block of foam 50, coated on its external surface with a metallization 51. In this case, several dielectric inserts 53A and 53B are used to symmetrize the responses in the E and H planes. As represented in FIG. 13, the foam block 50 comprises a central nook 52A for receiving a first central insert 53A made of a dielectric material and a circular groove 52B for receiving an insert formed by a circular ring 53B. In this case, the central insert makes it possible to correct the distortions at the level of the core of the focal spot while the insert at the periphery exhibiting the shape of a circular ring makes it possible to adapt the field distribution at the level of the periphery of the radiating aperture.

It is obvious to the person skilled in the art that the embodiments given above are merely examples that may be modified in numerous ways. In particular the geometry of the radiating aperture is not limited to that of a horn, such as represented in the figures. It may have any other shape, in particular the shape of pyramidal horns or of radiating apertures exhibiting other known shapes. Likewise the insert of dielectric material may have shapes other than the shapes given above. In particular the elliptical shape may be modified to a circular shape and the profile may have a different shape from a concave or convex shape.

What is claimed is:

1. Source antenna constituted by a radiating horn formed of a block of foam made of synthetic material whose external surface is metallized, the block of foam exhibiting several nooks realized at the level of the aperture side of the horn, each nook receiving an insert made of a dielectric material.

2. A source antenna according to claim 1, wherein the insert has an elliptical or circular shape along a section transverse to the aperture.

3. A source antenna according to claim 1, wherein the insert has a concave or convex shape along the axis of radiation.

* * * * *